US005918758A

United States Patent [19]

Galton-Fenzi

[11] Patent Number: 5,918,758

[45] **Date of Patent: *Jul. 6, 1999**

[54] CONTAINERS

[75] Inventor: Miles Doughlas Montague Galton-Fenzi, Cambridge, United Kingdom

[73] Assignee: BGF Health Care Products Ltd., Cambridge, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,438

[22] PCT Filed: Mar. 28, 1995

[86] PCT No.: PCT/GB95/00723

§ 371 Date: Oct. 23, 1996

§ 102(e) Date: Oct. 23, 1996

[87] PCT Pub. No.: WO95/26307

PCT Pub. Date: Oct. 5, 1995

[30] Foreign Application Priority Data

Mar. 29, 1994 [GB] United Kingdom ..... 9406238
Oct. 5, 1994 [GB] United Kingdom ..... 9420058

[51] Int. Cl.[6] ..... B65D 45/00

[52] U.S. Cl. ..... 220/315; 220/836; 215/206; 215/237; 70/63; 70/312

[58] Field of Search ..... 220/263, 315, 220/324, 334, 337, DIG. 20, 833, 836; 215/206, 237; 70/63, 312, 330, 331, 332, 333 A; 292/108, 102, 203, 210

[56] References Cited

U.S. PATENT DOCUMENTS

| | | | |
|---|---|---|---|
| 3,421,347 | 1/1969 | Sotory | 70/63 |
| 3,610,475 | 10/1971 | Gach | 220/315 X |
| 3,901,407 | 8/1975 | Mitchell . | |
| 3,930,388 | 1/1976 | Barras | 220/210 X |
| 3,988,909 | 11/1976 | Catapano | 70/63 |
| 4,343,163 | 8/1982 | Scelba et al. | 70/312 |
| 5,517,836 | 5/1996 | Hong | 70/30 |

FOREIGN PATENT DOCUMENTS

| | | |
|---|---|---|
| 148324 | 1/1903 | Germany . |
| 26 51 518 | 5/1978 | Germany . |

*Primary Examiner*—Stephen K. Cronin
*Attorney, Agent, or Firm*—Baker & Daniels

[57] ABSTRACT

A container requiring more than one operation to open, which comprises a hollow body, a lid for the body, the lid being releasably engaged such that the body is closed, and a marked member that is moveable between a first position at which the mark is hidden and the lid is engaged, and a second position at which the mark is visible and the lid is releasable.

12 Claims, 4 Drawing Sheets

CONTAINERS

FIELD OF THE INVENTION

This invention relates to containers, and in particular to security containers of the type requiring more than one operation to open them. Such containers include child-resistant containers that hold medicaments.

BACKGROUND OF THE INVENTION

It is these days common, and even a legal requirement, for certain types of container, such as pill boxes (that is to say, containers of pharmaceuticals or medicaments generally in solid dose form, such as pills or pellets), to be secure. More specifically, they should be child-proof (a term that usually means child-resistant) in that they must be difficult, and even impossible, to open, by a simple operation.

One known type of security container requires the (screw-on) lid to be pressed firmly down/on before it is unscrewed, while another requires the lid to be correctly aligned before it can be prised off. However, a press-down lid may be very difficult for the aged or arthritic to operate, while the most common container requiring alignment (of respective marks on the lid and on the container body) may be too easily opened by an intelligent child.

U.S. Pat. No. 4,535,903 describes a security container in which the lid includes a retractable member. When retracted, there is no evident means of opening the lid; manipulation of the member, through a window in the lid, allows it to be pushed out from the lid, only then providing an evident tab, for opening the lid. Although this device should be easy to operate without it being readily evident how it can be opened, it suffers from several practical disadvantages. These disadvantages include ease of opening, e.g. by a child using teeth, or accidental opening, even when the retractable member is retracted, and the difficulty of balancing ease of retraction/opening, e.g. for the infirm or those with large fingers, with desired security. Further, a bulky lid is required, especially if the retractable member is to be adequately durable, with attendant problems of plastic shrinkage, and difficulty in moulding and manufacture, e.g. non-suitability for ultrasonic welding. This also means that the container must be sufficiently large that it will not generally be considered portable.

SUMMARY OF THE INVENTION

According to the present invention, a container of the type requiring more than one operation to open, comprises a hollow body, a lid for the body, means for releasably engaging the lid such that the body is closed, and a marked member. The marked member is moveable between a first position at which the mark is hidden and said means engages the lid and a second position at which the mark is visible and the lid is releasable.

The novel container can avoid all the disadvantages associated with the prior art, while retaining their advantages.

DESCRIPTION OF THE INVENTION

The present invention proposes a variant of the alignment system. In a preferred embodiment, there is a knurled cylindrical knob sitting in a window-like aperture in the side of the container, and rotating this knob brings into view an alignment mark, the visibility of which indicates that the lid can now be prised open. More specifically, the invention provides a security container, perhaps for use as a pill-box, comprising a (conveniently hingedly) lidded container, the lid of which has a tongue reaching down into the body of the container; the tongue has a projecting lug that is detachably retained by physical interaction with a rotatable slotted wheel (or longitudinally-slotted, -grooved or -channelled cylinder) rotatably mounted in and projecting through the body wall; the wheel is turnable from without the body to bring the slot into or out of alignment with the lug, so as either to release the tongue, by permitting its lug to be withdrawn through the slot as the lid is lifted off the body, or to secure the tongue, by retaining the lug and thus preventing the lid being lifted off.

In one aspect, therefore, the invention provides a security container comprising a body with a lid fitting onto the body, wherein: the lid has a tongue reaching down (when the lid is shut) inside the container, the tongue having a lug projecting normally therefrom; the body has in a wall thereof an aperture in which a wheel is rotatably mounted axially parallel to the tongue so as to extend both inside and outside the body, with which wheel the tongue's lug can physically interact; and the wheel has across its rim surface a lug-matching and lug-alignable slot, and is rotatable, through the aperture from without the body, to bring the slot into or out of alignment with the lug.

The invention provides a security container comprising a body with a lid fitting onto the body. The container may naturally be of any size and shape, and for any purpose. Typically, however, the container will be for holding potentially dangerous chemicals, particularly the pharmaceutically-active chemicals used for medicaments in solid dose form, and exemplified by pills, pellets, tablets and capsules. Thus the container is what is more often referred to by the rather old-fashioned but slightly inaccurate term "pill box", which is used herein for convenience. Pill boxes are normally quite small, being cylindrical or cuboidal containers of about 50–60 cc capacity; a typical rectangular box would thus be about 20 mm deep by 40 mm wide by 80 mm tall (0.75×1.5×3 in).

The pill box of the invention may be used as a conveniently small, portable reservoir of pills filled from a larger supply stored elsewhere, or even as a container supplied to a pharmacist for filling and selling. However, the main use of the pill box of the invention is seen as a container to be supplied to a drug manufacturer or wholesaler, by whom it is then loaded and sealed, and then sent on to the retailer. The pill box, once empty, may be intended for disposal, or for re-filling and re-use.

The body of the container may be a one-piece item, formed as an integral whole, but can conveniently be of a two-piece construction, having an upper portion (on which the lid fits) mounted on and permanently attached, e.g. glued, ultrasonically-welded or held by means of a retaining device, to a lower portion. Advantageously, the upper portion incorporates the window (and slotted wheel), while the lower portion is simply for holding the intended contents of the container. In one preferred embodiment, the body is of such a two-piece form, and the top part is itself in two side-by-side portions secured together (as explained below, this facilitates the mounting of the wheel).

The components of the container may each be of any suitable material. A preferred type of material, which allows the container to be shaped almost without restriction, is a synthetic resin, or plastics, of the thermoplastic variety, e.g. a polyalkylene, polystyrene, or polyacrylic. The material may be transparent. In particular, it may be desirable to have the bottom half of the container body transparent, so that its contents, or lack thereof, can plainly be seen. The upper, wheel-mounting portion may be of another, opaque, substance.

The container has a body with a lid fitting thereon. Although the lid could notionally be "loose", in the sense of being quite separate from the body, most conveniently the lid is hingedly attached to the container, desirably by a conventional hinge/pin mechanism. Where the lid and container body are made of a suitable plastics material, the two can also be a single item, the lid formed integrally together with the body and "joined" thereto by a thin web of material which flexes, and so can act as the desired hinge. In the case where the body is, in horizontal cross-section, oblong, with a pair of narrower sides and a pair of wider sides, the lid is most conveniently so hinged on one of the shorter sides.

The lid may be in essence no more than a flat piece of material, perhaps with some small peripheral downwardly-directed flange on its undersurface to facilitate its fitting onto the container's body. In one embodiment, a hinged lid may have downwardly-directed side flanges or flaps (with an arcuate edge at the hinge-distant side), so that together with the lid itself they form a channel through which the container's contents are guided to the user's hand.

In a preferred security container of the invention, the lid has a tongue reaching down (when the lid is shut) inside the container, and the tongue has a lug projecting normally therefrom. In essence, the tongue is a short stiff fairly narrow flap of material (conveniently integral with the lid) that projects normally from the under surface of the lid. When the lid is shut, the tongue preferably lies within the body closely adjacent one wall of the container (the wall in which is mounted the wheel). Where the lid is hinged to the body, the tongue is preferably positioned near that side edge of the lid distant from the hinge; then, when the lid is closed, the tongue will lie adjacent that body wall distant from the one to which the lid is hinged.

The lid's tongue has a lug projecting normally therefrom, this lug in use physically interacting with, a "hooking" under, the wheel, so as to control the opening of the lid. In one form, the tongue and lug combination looks rather like the letter L (where the upright is the tongue, attached at its top to the underneath of the lid, and the horizontal bar is the lug). In another form, however, the tongue/lug combination looks more like a square cut letter C (or, perhaps, another letter L but with a very thick top end to the upright). This is as if the tongue itself, though narrow, had significant depth, and had had a notch cut out of it about halfway down; in this embodiment, the bottom of the tongue, i.e. that part defining the bottom edge of the notch, constitutes the lug. In either case, in use and with the lid closed, the lug projects out into physical, interactive, contact with and "behind" the wheel. Depending on the position of the wheel, the lug is either in alignment with the slot in the wheel (in which case the lid can be opened) or is not (in which case the lid cannot be opened).

The tongue and lug combination interacts with the slotted wheel so as to control the opening of the security container. There may, however, be some secondary lid opening control, or retaining, means, especially if it is preferred to keep the lid shut, even if the wheel's slot is aligned with the lug, until some positive effort is expended to open the lid. For example, the lid (or its tongue) may bear some small projecting pips, or nodules, which when the lid is shut co-operate with corresponding dimples, or depressions in the body, to provide a slight lid-locating bias acting to stop the lid opening unless the user actually prises it open. One advantage of having such a secondary lid retaining means is that when, after the lid has been opened to access the container's contents, the lid is re-shut, it will generally stay shut, preventing the contents falling out, even though the wheel is not rotated to bring the slot out of lug-alignment.

In a wall of the body there is an aperture, and in this aperture there is mounted the wheel. The aperture may take any form—any size, shape and position—suitable for the wheel; most conveniently it is a simple rectangular aperture, like a window, of such dimensions that the wheel fits therein loosely enough to permit the wheel to be turned but tightly enough to prevent the container's contents from falling out through any gaps between the wheel and the aperture sides. To assist in this the aperture's sides may be shaped, angled or bevelled, so as more closely to "fit" to the wheel's surface.

The wheel is rotatably mounted so that it can be turned around (by the thumb of the user, say) to bring the slot into or out of alignment with the lug. The axis of rotation is parallel to the tongue, i.e. parallel to the line along which the lug on the tongue moves when the lid is pushed down onto, or lifted up off, the top of the container body. Therefore, in use, the slot, which extends across the rim of the wheel from one side to the other (and thus parallel to the wheel's axis), can be moved into and out of alignment with the lug. The wheel is mounted in the aperture so that it extends both inside the container body, where it interacts with the tongue's lug, and outside the body, where it can be operated by the user. Most conveniently, the mounting is such that the wheel surface is almost flush with, standing only a little proud of, the body's outside surface; in this way the wheel does not stick far enough out of the body to be easily turned by mistake, or to be damaged by physical contact with the outside world, yet is still simply operable by the user.

The manner in which the wheel is mounted in, i.e. attached to and held in or by, the container body may be any appropriate. In one preferred embodiment, the wall of the body containing the aperture is of appreciable thickness, and the wheel has an axial mounting spindle, the ends of which are located in suitably sized and positioned holes formed in that wall. Placing the spindle in these holes is facilitated by having the aperture-containing upper part of the body formed in two side-by-side portions that can be pressed together, possibly by using one or more interference fits, to make the whole, the spindle holes being contrived by facing matching grooves extending from facing matching "half-aperture" openings; if the wheel is positioned in the half aperture in one portion, with its spindle in the corresponding grooves, the second portion may then be located on top, making the top part of the body and simultaneously holding the spindle, and wheel, in place. Alternatively, when using a two-part body for the container, the upper and lower spindle holes may be formed (during some moulding stage, say) so that the wheel may be placed on the lower part with its lower spindle in the lower hole, and the upper part then pushed into place while guiding the upper spindle into the upper hole. In yet another version, the wall is thinner but has two pairs of spaced lugs projecting from its internal surface, one pair each above and below the aperture, and the wheel's spindle is a snap fit into the lug space.

The wheel is rotatably mounted in the aperture. The ease of rotation is preferably not too great, or else the wheel will spin around almost without user intervention. Preferably, the wheel is a good fit within its mounting, for example, by fixing the wheel on its spindle and making the spindle a tight fit within its mounting holes. One way to achieve the sort of fit required is to lightly knurl both the outside surface of the spindle and the inside surface of the mounting holes.

The wheel and the housing may have corresponding location means, e.g. respective depression(s) and pimple(s), for the open position. The degree of resistance to further turning will help to inform the user that the lid is openable, but this can be a relatively small effect, in order not to compromise the desired child-resistance.

The wheel itself may take one of a number of forms. It may, for example, be truly wheel-like, being narrow relative to its diameter. It may have a lug slot extending from side to side across its rim surface; when using such a wheel, the tongue extends from the lid sufficiently far that, when the lid is shut, the lug actually lies beyond the wheel, so "hooking" behind the wheel (until released by rotating the wheel until the slot is aligned with the lug).

Alternatively, and preferably, the wheel may be more like a cylinder, with an axial length that is large relative to its diameter. With such a cylindrical wheel, it is preferred that the cylinder has, at roughly its midpoint, and communicating with the lug slot (which extends down from the top/lid end of the cylinder), a suitably-sized circumferential groove into which the lug loosely fits, so that the lug hooks into this groove rather than under/behind the lid-distant side of the wheel (and thus so that the tongue need not be especially long).

The wheel has a diameter sufficient to provide a satisfactory user-interactive surface lying in or just proud of the aperture, and this will conveniently be attained by sizing the wheel so that it is the biggest that can still fit within the internal width of the container body. The rim surface of the wheel is conveniently knurled, so as to increase the friction between the surface and the user's thumb (say), and thus make it easier to turn the wheel.

The wheel bears some sort of marking, such as an arrow, to be aligned with a marking (such as another arrow) on the body. It is then evident that the lug and slot are in alignment, and thus that the lid can be removed (or replaced). When the lid is securely fastened, the wheel is rotated sufficiently that the marking is not evident through the aperture.

Once the lid is open, the contents of the security container can be accessed. For instance, pills therein can be poured out. Desirably, the upper portion of the container body is given an internal shape much like that of an inverted funnel, so that the outward flow of the contents is restricted, and they come out one or two at a time.

An embodiment of the invention is now described, though way of illustration only, with reference to the accompanying drawings in which.

Figure 1A:
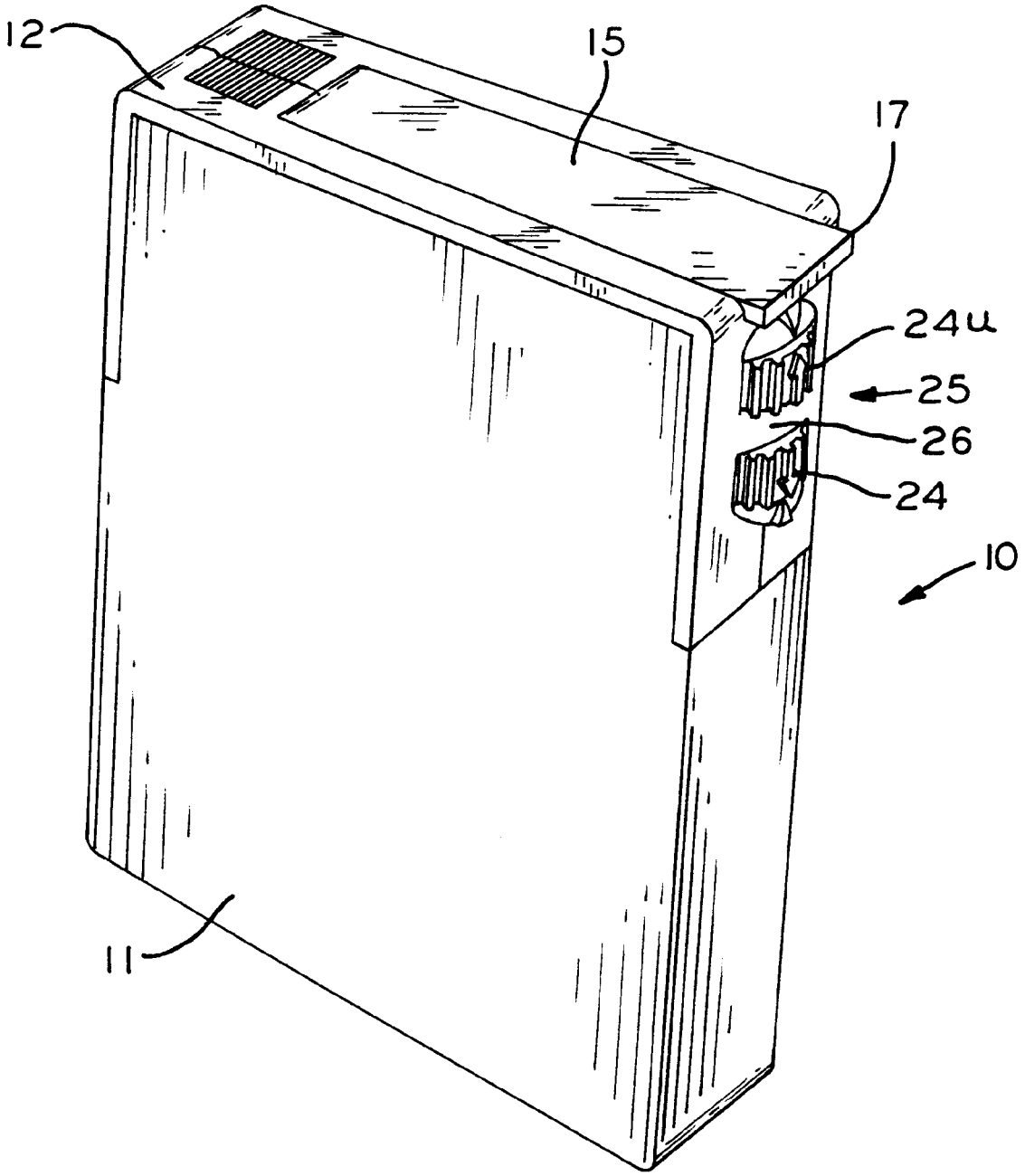
FIG. 1A is a perspective view of the embodiment.
Figure 1B:
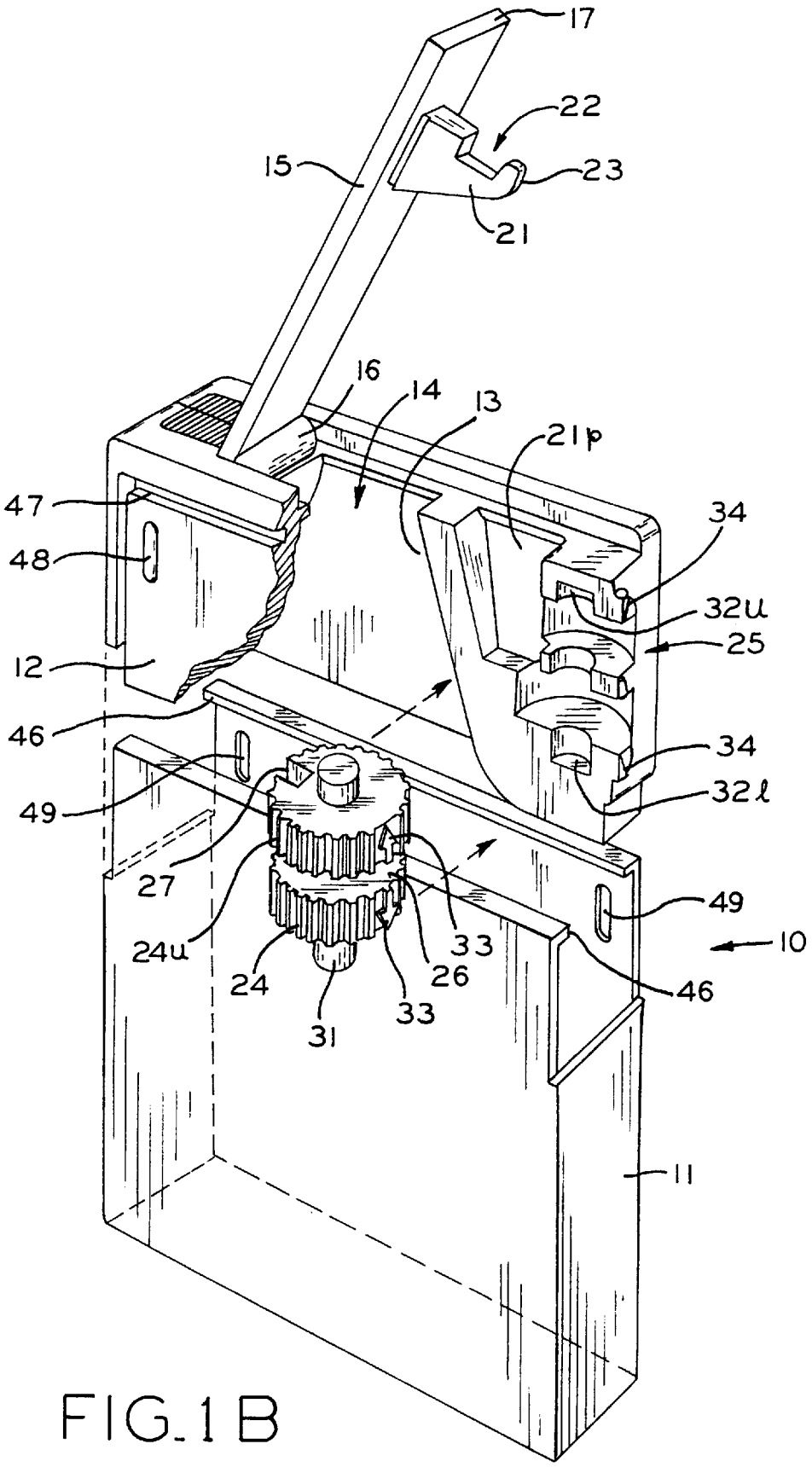
FIG. 1B is the same view as FIG. 1A, but partly see-through, or exploded.
Figure 2A:
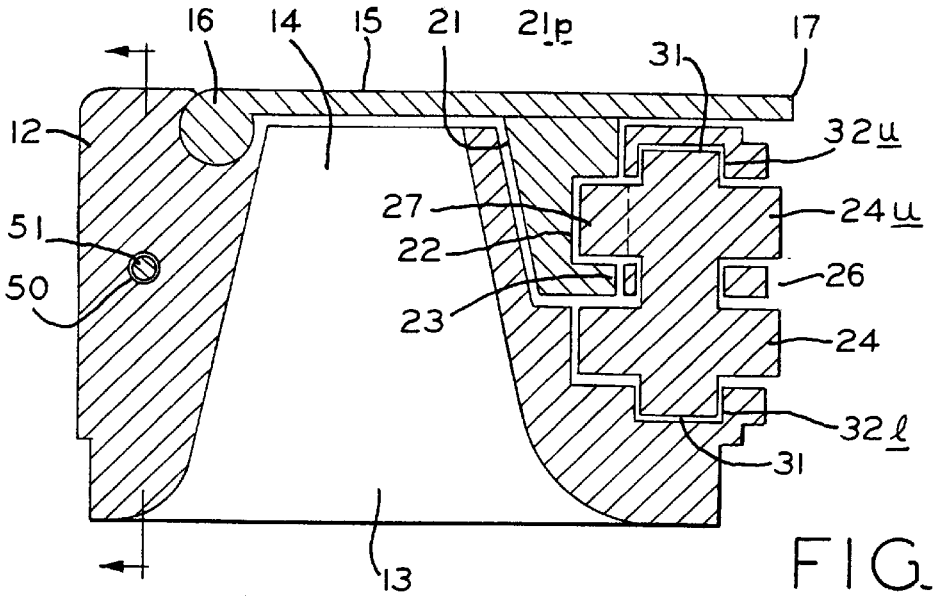
FIGS. 2A to 2C are see-through views, respectively side, top and plan, of the upper portion of the container of FIG. 1.
Figure 2B:
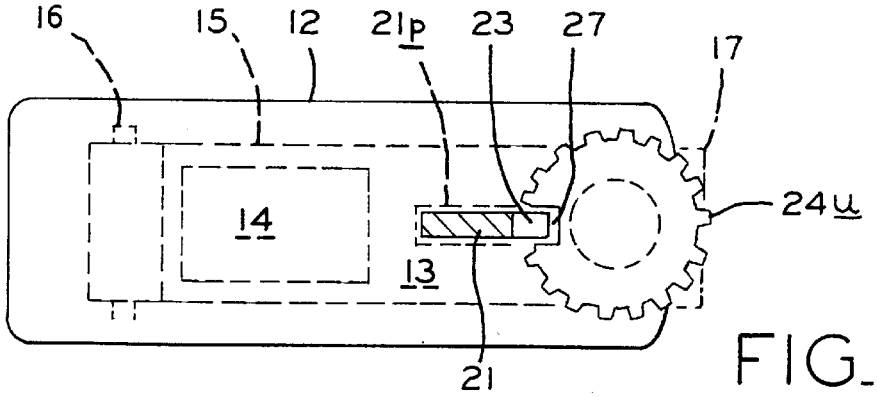
Figure 2C:
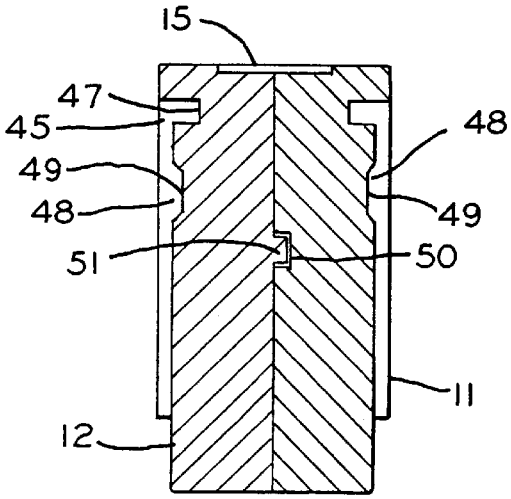

The security container, or pill box, of the invention shown in FIGS. 1 and 2 has a tall, deep and narrow rectangular body (generally 10) of two-part construction, there being a hollow lower body part (11) in which the pills (not shown) are stored. In one configuration the wider sides of the lower body part (11) extend higher than the two narrow sides, giving the impression from one view of a U-shaped lower container (11: FIG. 1B). On the two high sides is a form of 'ledge' (46) which slots or clips into the upper section in which a rebate (47) is situated (FIG. 1B) within the upper body part (12). The upper body part (12) can be sealingly mounted on the lower body part (11) and has a funnel-like passageway (13: Figure 1B) therein. The passageway communicates with the inside of the lower part and leads to the outside via an opening (14), which opening is closeable by a lid (15). On the upper body part there are four recesses (49), two located either side of the upper body part (12), which locate onto corresponding pimples (48) located on the inner surface of the longest side of the lower container (11) (FIGS. 1B and 2C). The upper body of the container (12) may be held together using one or more interference joints, the location of which can vary. A recess (50) is located on one side of the upper body (12), and on the other half a 'pimple' or 'nodule' (51) (best seen in FIG. 2C). The lid is hinged (at one narrow end thereof, 16) to the body upper part (12) and extends along and beyond the opposite narrow end, where (when closed) it slightly overhangs the body so as to form a lip (17) by which it can be pushed up and open.

Depending from the under (as viewed) surface of the lid is a tongue (21: FIG. 1B) that has a notch (22) in it so to form a lug (23) projecting from the tongue (but in the plane thereof). This tongue, and this lug, fit into a passageway (21p) reaching down from the upper face of the upper body portion (12), and co-operate with an elongate knurled thumbwheel (24) rotatably mounted within a correspondingly-shaped aperture (25) in the side of the upper body part (12) as to project slightly therefrom (see also FIG. 2). The upper (as viewed) half (24u) of the thumbwheel (24) has a lug-deep channel (26) around its middle; when the lid (15) is closed then, as best shown in FIG. 2A, the upper wheel portion (24u) fits neatly into the tongue's notch (22), while the tongue's lug (23) fits neatly into the channel (26).

The upper half (24u) of the wheel (24) also has a vertical (as viewed) tongue-wide slot (27) cut in it (as best seen in FIGS. 1B and 2B). The wheel (24) is mounted using a spindle (31) rotatably located within spindle holes (32u,32l), and can be rotated around the spindle axis so as to bring the slot into or out of alignment with the tongue's lug (23). When it is so aligned, as shown in FIG. 2, the tongue (21) can be pushed down the slot (21p), to allow the lid (15) to be closed, or alternatively it can be pulled out of the slot, to allow lid (15) to be opened. However, if the wheel (24) is so positioned (in its rotation) that the slot (27) and lug (23) are misaligned, then if the lid (15) is already closed it cannot be opened (without, of course, re-aligning the slot).

To assist in aligning the slot (27) with the lug (23), suitably slot-relative arrow pointers (33) on the wheel (24) can be aligned with similar arrow pointers (as 34) on the outer surface of the upper body portion (12).

Figure 3A:
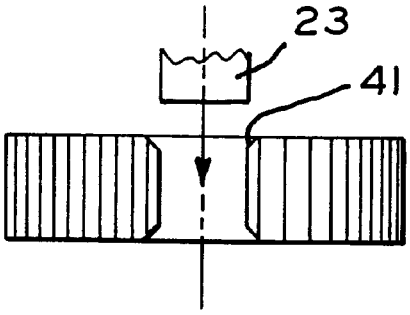
FIGS. 3A to 3C show details of the lid parts of the same embodiment.
Figure 3B:
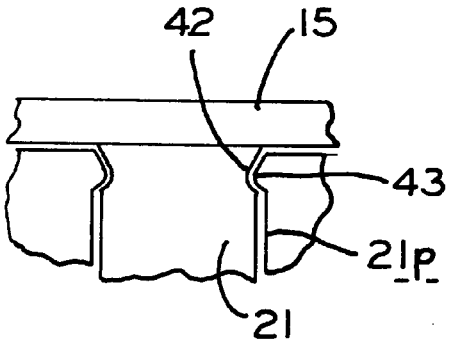
Figure 3C:
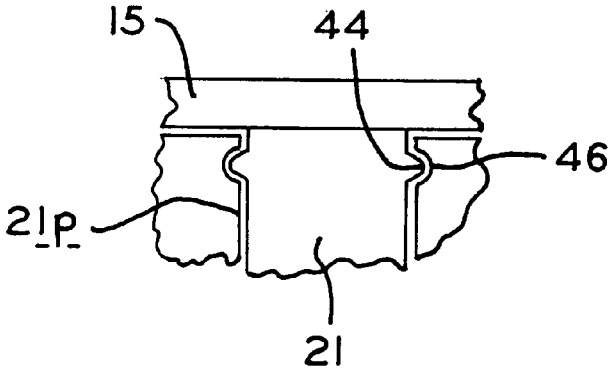

FIG. 3A shows how the end faces of the wheel's slot (27) are slightly bevelled (at 41), so as more easily to guide the tongue (21) into place. FIGS. 3B/C show different ways of arranging for the lid actually to stay shut when it is pushed closed, even the wheel (24) is not immediately rotated to bring the slot into misalignment. In one (FIG. 3B), the very base of the tongue (21) has shallow recesses or depressions (as 42) along either side, which co-operate as a sort of friction fit with raised areas (as 43) on the corresponding parts of the side surfaces of the passageway (21p); in the FIG. 3C embodiment, things are the other way round, in that raised areas (as 44) at the base of the tongue (21) fit into corresponding depressions (as 45) in the side walls of the passageway (21p).

I claim:

1. A container requiring more than one operation to open, which comprises a hollow body, a lid for the body, means for releasably engaging the lid such that the body is closed, and a single rotatable knob having a single mark disposed on a circumferential face of said knob, with the remaining portions of said knob being unmarked, said body including a window-like aperture within which said knob is movable, said knob being rotatable about an axis that is generally parallel to a plane defined by said aperture, said knob being moveable between a first position at which the mark is hidden and said means engages the lid and a second position at which the mark is visible and the lid is releasable.

2. A container according claim 1, in which the body comprises an indicator (34) with which the mark is aligned, in the second position.

3. A container according to claim 1, in which the lid is hingedly attached to the body and said means includes a tongue (21), reaching into the body, with a lug (23) that is retained by the knob in the first position, the member having a corresponding slot through which the tongue is releasable, in the second position.

4. A container according to claim 3, in which the body comprises an indicator with which the mark is aligned, in the second position.

5. A container requiring more than one operation to open, which comprises a hollow body, a lid for the body, means for releasably engaging the lid such that the body is closed, and a single marked member having only a single mark and being only partially visible through an aperture in said hollow body, the marked member moveable between a first position at which the mark is hidden and said means engages the lid and a second position at which the mark is visible and the lid is releasable.

6. A container according to claim 5, in which the body comprises an indicator with which the mark is aligned, in the second position.

7. A container according to claim 5, in which the lid is hingedly attached to the body and said means includes a tongue, reaching into the body, with a lug that is retained by the member in the first position, the member having a corresponding slot through which the tongue is releasable, in the second position.

8. A container according to claim 7, in which the body comprises an indicator with which the mark is aligned, in the second position.

9. A container according to claim 5, in which the marked member is a rotatable knob.

10. A container according to claim 9, in which the body comprises an indicator with which the mark is aligned, in the second position.

11. A container according to claim 9, in which the lid is hingedly attached to the body and said means includes a tongue, reaching into the body, with a lug that is retained by the member in the first position, the member having a corresponding slot through which the tongue is releasable, in the second position.

12. A container according to claim 11, in which the body comprises an indicator with which the mark is aligned, in the second position.

* * * * *